US007406928B2

(12) United States Patent
Franke et al.

(10) Patent No.: US 7,406,928 B2
(45) Date of Patent: Aug. 5, 2008

(54) HORIZONTALLY CONSTRUCTED CONTINUOUS STEAM GENERATOR AND METHOD FOR THE OPERATION THEREOF

(75) Inventors: Joachim Franke, Altdorf (DE); Rudolf Kral, Stulln (DE)

(73) Assignee: Siemens Aktiengesellschaft, Munich (DE)

( * ) Notice: Subject to any disclaimer, the term of this patent is extended or adjusted under 35 U.S.C. 154(b) by 196 days.

(21) Appl. No.: 10/570,652

(22) PCT Filed: Aug. 2, 2004

(86) PCT No.: PCT/EP2004/008644

§ 371 (c)(1),
(2), (4) Date: Mar. 3, 2006

(87) PCT Pub. No.: WO2005/028956

PCT Pub. Date: Mar. 31, 2005

(65) Prior Publication Data

US 2006/0288962 A1 Dec. 28, 2006

(30) Foreign Application Priority Data

Sep. 3, 2003 (EP) ..... 03020022

(51) Int. Cl.
*F22B 35/10* (2006.01)

(52) U.S. Cl. ..... 122/451 S; 122/1 B; 122/406.4; 122/409

(58) Field of Classification Search ..... 122/1 B, 122/1 C, 406.4, 7 R, 409, 451 S
See application file for complete search history.

(56) References Cited

U.S. PATENT DOCUMENTS 3,357,411 A * 12/1967 Kamm ..... 122/406.4
4,466,241 A * 8/1984 Inui et al. ..... 60/39.182

(Continued)

FOREIGN PATENT DOCUMENTS

DE 197 00 350 A1 7/1998

(Continued)

OTHER PUBLICATIONS

S. Wambeke, "Shortcut Methods for Measuring HRSG Performance", Power, McGraw-Hill Inc., New York, US. vol. 145, No. 1, Jan. 1, 2001, p. 56-58, XP001001066.

*Primary Examiner*—Gregory A Wilson

(57) ABSTRACT

The invention relates to a continuous steam generator provided, in a duct for hot gas circulating in a substantially horizontal direction, with a continuous heating surface of an evaporator comprising a plurality of steam generator tubes which are mounted in parallel for circulating a fluid flow. The inventive device requires exceptionally low construction expenditures and ensures a high degree of safety and a high efficiency. For this purpose, the continuous heating surface of the evaporator is characterized in that it comprises a segment of the heating surface through which a moving fluid flows in an opposite direction with respect to the heated gas direction is positioned in such a way that a saturated steam temperature which is adjusted during operation at the exit from the continuous heating surface deviates from the predetermined maximum value of the temperature of the gas prevailing during operation at the outlet of the segment of the heating surface. In addition, one or several entry collectors are disposed at a close distance from the outlet of the heating surface on the gas side in such a way that the moving fluid has a flow speed in the downpipe which is higher than the minimum speed required for pulling nascent steam bubbles.

10 Claims, 1 Drawing Sheet

U.S. PATENT DOCUMENTS 4,858,562 A * 8/1989 Arakawa et al. ..... 122/7 R
5,159,897 A 11/1992 Franke et al.
5,588,400 A * 12/1996 Stefan et al. ..... 122/406.1
5,924,389 A * 7/1999 Palkes et al. ..... 122/7 R
6,019,070 A 2/2000 Duffy
6,092,490 A 7/2000 Bairley et al.
6,508,206 B1 1/2003 Rechtman
6,557,500 B1 * 5/2003 Schroeder ..... 122/7 R
7,270,086 B2 * 9/2007 Franke et al. ..... 122/7 R

FOREIGN PATENT DOCUMENTS

DE 101 27 830 A1 12/2002
EP 0 794 320 A1 9/1997

* cited by examiner

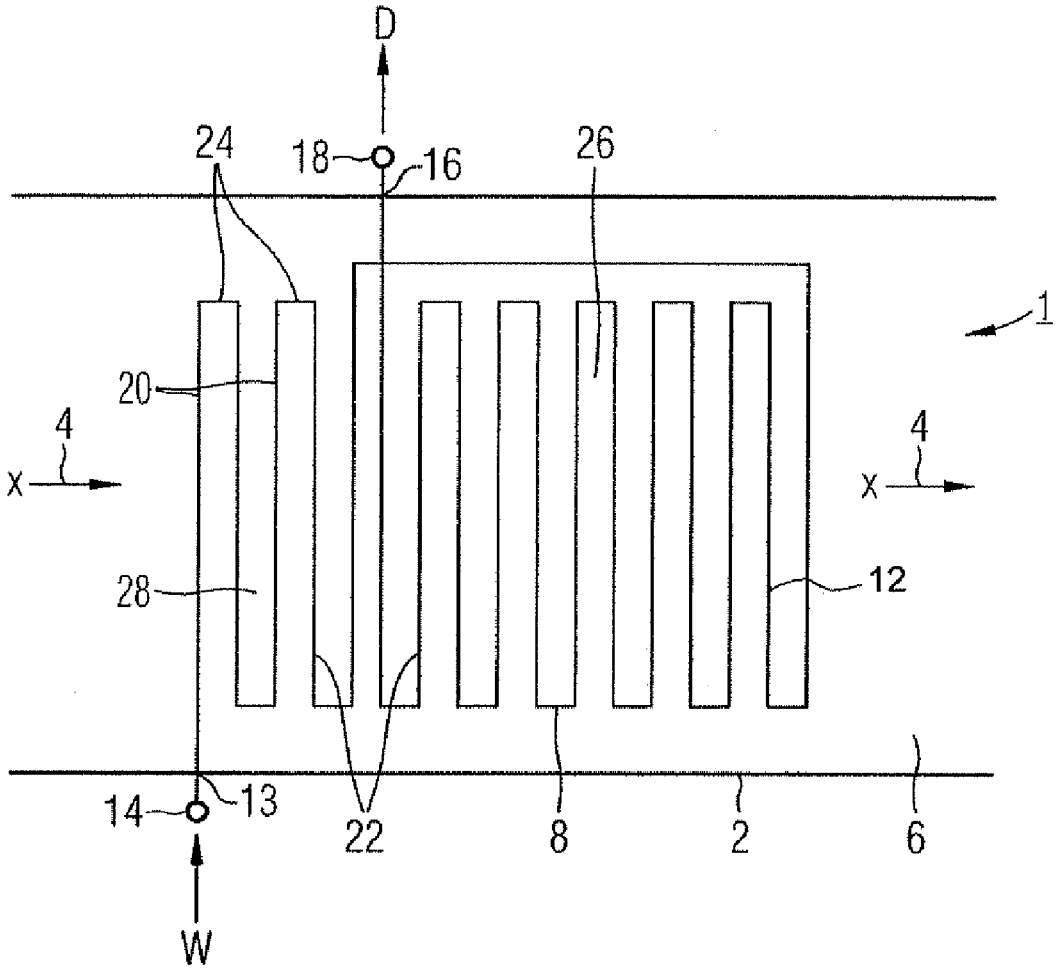
D
24
18
16
26
1
20
4
x
4
x
28
12
14
13
22
8
2
6
W

HORIZONTALLY CONSTRUCTED CONTINUOUS STEAM GENERATOR AND METHOD FOR THE OPERATION THEREOF

CROSS REFERENCE TO RELATED APPLICATION

This application is the US National Stage of International Application No. PCT/EP2004/008644, filed Aug. 2, 2004 and claims the benefit thereof. The International Application claims the benefits of European Patent application No. 03020022.4 EP filed Sep. 03, 2003, both of the applications are incorporated by reference herein in their entirety.

FIELD OF THE INVENTION

The invention relates to a continuous steam generator wherein a continuous evaporator heating surface comprising a plurality of parallel-connected steam generator tubes providing a flow path for a flow medium is disposed in a hot gas duct through which hot gas can flow in an approximately horizontal direction.

BACKGROUND OF THE INVENTION

In a gas and steam turbine plant, the heat contained in the expanded working medium or heating gas from the gas turbine is utilized for the generation of steam for the steam turbine. Heat transfer takes place in a waste-heat steam generator disposed downstream of the gas turbine and in which a number of heating surfaces for water preheating, steam generation and steam superheating are normally disposed. The heating surfaces are connected into the water/steam circuit of the steam turbine. The water/steam circuit normally contains several, e.g. three, pressure stages, in which case each pressure stage may have an evaporator heating surface.

For the steam generator mounted downstream of the gas turbine on the heating-gas side as a waste-heat steam generator, a number of alternative design concepts are suitable, namely configuration as a continuous steam generator or as a circulation steam generator. In the case of a continuous steam generator, the heating of steam-generator tubes provided as evaporator tubes results in evaporation of the flow medium in the steam generator tubes in a single pass. In contrast, in the case of a natural or forced circulation steam generator, the circulating water is only partly evaporated as it passes through the evaporator tubes, the water that is not evaporated being is re-fed to the same evaporator tubes for further evaporation after separation of the generated steam.

A continuous steam generator, in contrast to a natural or forced circulation steam generator, is not subject to any pressure limitation, which means that live-steam pressures well above the critical pressure of water ($P_{cri}\approx 221$ bar)—where there is only a slight difference in density between a fluid-like medium and a steam-like medium—are possible. A high live steam pressure promotes high thermal efficiency and therefore low $CO_2$ emissions from a fossil-fired power plant. In addition, a continuous steam generator has a simple type of construction compared with a circulation steam generator and can therefore be manufactured particularly inexpensively. The use of a steam generator designed according to the continuous principle as the waste-heat steam generator of a gas and steam turbine plant is therefore particularly advantageous for achieving a high overall efficiency of the gas and steam turbine plant using a simple type of construction.

Particular advantages in terms of manufacturing costs, but also of maintenance required, are provided by a horizontally constructed waste-heat steam generator in which the heating medium or heating gas, i.e. the exhaust gas from the gas turbine, is passed through the steam generator in an approximately horizontal flow direction. However, with a horizontally constructed continuous steam generator the steam generator tubes of a heating surface may be subjected to markedly differential heating depending on their positioning. Particularly in the case of steam generator tubes connected to a common header on the output side, differential heating of individual steam generator tubes may result in a combining of steam flows with greatly differing steam parameters and therefore undesirable efficiency losses, in particular comparatively diminished effectiveness of the heating surfaces affected and consequently reduced steam generation. Differential heating of adjacent steam generator tubes may also result in damage to the steam generator tubes or the header, particularly in the region where they discharge into headers. The per se desirable use of a horizontally constructed continuous steam generator as a waste-heat steam generator for a gas turbine can therefore entail considerable problems in terms of sufficiently stabilized flow control.

EP 0 944 801 B1 discloses a steam generator suitable for a horizontal type of construction and additionally having the abovementioned advantages of a continuous steam generator. To this end, the disclosed steam generator is designed in respect of its continuous evaporator heating surface in such a way that a steam generator tube heated more than another steam generator tube of the same continuous evaporator heating surface has a higher throughput of flow medium than the other steam generator tube. If differential heating of individual steam generator tubes occurs, the continuous evaporator heating surface of the steam generator disclosed therefore exhibits, in its flow characteristic typical of a natural circulation evaporator heating surface (natural circulation characteristic), a self-stabilizing behavior resulting in a matching of the outlet-side temperatures even to differentially heated steam generator tubes connected in parallel on the flow medium side without the need for external intervention. However, this concept requires that the disclosed steam generator be designed for feeding with flow medium having comparatively low mass flow density.

SUMMARY OF THE INVENTION

The object of the invention is therefore to specify a continuous steam generator of the abovementioned type which ensures particularly high operational reliability even when fed with flow medium with comparatively high mass flow densities. In addition, a particularly suitable method for operating the steam generator of the abovementioned type shall be set forth.

To achieve this object with respect to the continuous steam generator, the continuous evaporator heating surface comprises a first heating surface segment through which the flow medium can flow countercurrently to the heating gas duct and another heating surface segment connected upstream of said heating surface segment on the flow medium and heating gas side, the flow-medium-side outlet of the first heating gas segment viewed in the heating gas direction being positioned such that the pressure-dependent saturated steam temperature arising at the outlet of the continuous evaporator heating surface during operation deviates by less than a predefined maximum deviation of no more than 70° C. from the heating gas temperature obtaining at the position of the outlet of the heating surface segment during operation.

The invention is based on the consideration that, if the continuous evaporator heating-surface is fed with comparatively high mass flow densities, locally differential heating of individual tubes could affect the flow conditions in such a way that less flow medium flows through more strongly heated tubes and more flow medium flows through less strongly heated tubes. More strongly heated tubes would in this case be cooled worse than less strongly heated tubes, with the result that the temperature differences occurring would be automatically amplified. In order to be able to effectively meet this eventuality even without actively influencing the flow conditions, the system must be suitably designed for fundamental and total limiting of possible temperature differences. To this end, the knowledge can be used that, at the outlet from the continuous evaporator heating surface, the flow medium must have at least the saturated steam temperature essentially due to the pressure in the steam generator tube. On the other hand, however, the flow medium can have a temperature no higher than that of the heating gas at the point of outlet of the flow medium from the continuous evaporator heating surface. By suitably matching these two temperature limits generally defining the possible temperature interval, the maximum possible temperature imbalances can therefore also be suitably limited. By subdividing the continuous evaporator heating surface into an outlet-side counterflow segment and another segment upstream of it on the heating gas and media side, the outlet is freely positionable in the heating gas direction, with the result that an additional design parameter is available, a particularly suitable means of matching the two temperature limits being the selective positioning of the outlet of the continuous evaporator heating surface in the flow direction of the heating gas.

The positioning of the outlet of the continuous evaporator heating surface in relation to the temperature profile of the heating gas in the gas flue is advantageously selected such that a maximum deviation of approximately 50° C. is maintained so as to ensure particularly high operating reliability in respect of available materials and further design parameters.

A particularly simple and therefore also robust type of construction can be achieved by making the heating surface particularly simple in respect of collecting and distributing the flow medium. To this end, the heating surface is suitably implemented for performing all the process steps of complete evaporation, i.e. pre-heating, evaporation and at least partial superheating, in a single stage, i.e. without interposed components for collecting and/or distributing the flow medium. A number of steam generator tubes therefore advantageously comprise a plurality of riser and downcomer tube sections connected in series in an alternating manner on the flow medium side.

In this arrangement heating takes place both in the riser and downcomer tube sections. However, such a connection of steam generator tubes in which heating of downflow tube sections also takes place generally involves the risk of flow instabilities occurring. It has been found that the occurrence of steam bubbles in downflow steam generator tubes may be regarded as one of the possible causes of this. If steam bubbles were to form in a downflow steam generator tube, they could rise in the water column present in the steam generator tube, thereby performing a movement counter to the flow direction of the flow medium. In order to consistently prevent any such movement of steam bubbles possibly present against the flow direction of the flow medium, forced entrainment of the steam bubbles in the actual flow direction of the flow medium must be ensured by suitable specification of operating parameters. This can be achieved by arranging that the continuous evaporator heating surface is fed in such a way that the flow rate of the flow medium in the steam generator tubes has the desired entrainment effect on any steam bubbles present. A comparatively high flow rate even in the first downflow steam generator tube can be achieved in a very simple manner by means of comparatively strong heating of the steam generator tubes at the flow-medium-side inlet and the resultant rapid increase in the steam content of the flow medium. For this purpose the flow-medium-side inlet of the continuous evaporator heating surface is advantageously implemented as a riser tube section and disposed close to the heating-gas-side inlet of the continuous evaporator heating surface in such a way that, during operation, the flow medium flowing through the steam generator tubes has a flow rate higher than a predefined minimum rate at the inlet of the first downcomer tube section.

The first riser and downcomer tube sections preferably constitute an additional heating surface segment disposed in a cocurrent flow configuration, hereinafter also referred to as a cocurrent segment, which advantageously precedes, on the flow medium side, the heating surface segment advantageously disposed in a countercurrent flow configuration, hereinafter also referred to as a countercurrent segment. By means of such an arrangement of the segments in the heating gas duct, the advantage of a pure countercurrent flow configuration, that of effectively transferring the heat of the exhaust gas to the flow medium, is largely retained while at the same time achieving a high inherent safeguard against damaging temperature differences at the flow-medium-side outlet.

In an alternative advantageous embodiment, however, the additional heating surface segment can also be connected countercurrently with respect to the heating gas direction.

The steam generator is usefully employed as a waste-heat steam generator of a gas and steam turbine system, the steam generator being advantageously connected downstream of a gas turbine on the heating gas side. In this arrangement, it is advisable for supplementary firing for increasing the heating gas temperature to be disposed downstream of the gas turbine.

In respect of the method, the abovementioned object is achieved by educting the flow medium from the continuous evaporator heating surface in the heating gas direction at a position at which the heating gas temperature obtaining during operation deviates by less than a predefined maximum deviation of no more than 70° C. from the saturated steam temperature arising during operation as a result of the pressure loss in the continuous evaporator heating surface.

Upstream of its outlet from the continuous evaporator heating surface, the flow medium is advantageously fed countercurrently to the heating gas, a maximum deviation of approximately 50° C. being specified in an additional or alternative advantageous embodiment.

In order to consistently prevent any flow instabilities from occurring, the flow medium is advantageously exposed to strong heating at or immediately after the inlet to the continuous evaporator heating surface in such a way that it exhibits a flow rate of more than a specified minimum rate in a first riser tube section of the relevant steam generator tube.

Advantageously the flow rate required for the entrainment of steam bubbles produced in the relevant first downcomer tube section is predefined. The continuous evaporator heating surface is therefore fed in such a way that, even in the first downflow steam generator tube, the comparatively high flow rate has the desired entrainment effect on any steam bubbles present, thereby reliably preventing flow instabilities caused by any movement of rising steam bubbles against the flow direction of the flow medium.

The advantages achieved with the invention are in particular that, by means of the now provided positioning of the flow-medium-side outlet of the continuous evaporator heating surface, adapted to the temperature profile of the heating gas in the gas flue, the overall achievable temperature interval between saturated steam temperature of the flow medium and heating gas temperature at the point of outlet during evaporation of the flow medium is comparatively tightly limited, so that only small outlet-side temperature differences are possible irrespective of the flow conditions, thereby ensuring adequate matching of the temperatures of the flow medium in every operating state. However, it is also ensured, moreover, that the possible outlet temperatures are limited in absolute terms, so that they remain reliably within the permissible temperature limits predefined by the material properties.

BRIEF DESCRIPTION OF THE DRAWING

An exemplary embodiment of the invention will now be explained in greater detail with reference to the accompanying drawing. Said FIGURE is a simplified view in longitudinal section of a horizontally constructed continuous steam generator.

DETAILED DESCRIPTION OF THE INVENTION

The continuous steam generator 1 according to the FIGURE is connected downstream of a gas turbine (not shown) on the exhaust gas side in the manner of a waste-heat steam generator. The continuous steam generator 1 has a surrounding wall 2 which forms a heating gas duct 6 for the exhaust gas from the gas turbine, heating gas flowing through said duct 6 in an approximately horizontal direction x indicated by the arrows 4. In the heating gas duct 6 there are disposed a number of heating surfaces designed according to the continuous principle, also termed continuous evaporator heating surface 8. Although only one continuous evaporator heating surface 8 is shown in the example depicted in the FIGURE, a larger number of continuous evaporator heating surfaces can also be provided.

The evaporator system formed by the continuous evaporator heating surface 8 can be impinged by flow medium W which evaporates in a single pass through the continuous evaporator heating surface 8 and, on leaving the continuous evaporator heating surface 8, is educted as steam D and generally fed to superheater heating surfaces for further superheating. The evaporator system formed by the continuous evaporator heating surface 8 is connected into the water-steam circuit of a steam turbine (not shown in greater detail). In addition to the evaporator system, the water-steam circuit of the steam turbine contains a number of other heating surfaces not shown in greater detail in the FIGURE. The heating surfaces can be e.g. superheaters, medium pressure evaporators, low-pressure evaporators and/or economizers.

The continuous evaporator heating surface 8 of the continuous steam generator 1 according to the FIGURE comprises, in the manner of a tube bundle, a plurality of parallel-connected steam generator tubes 12 providing a flow path for the flow medium W. A plurality of steam generator tubes 12 is disposed side by side viewed in the heating gas direction x, only one of the thus disposed steam generator tubes 12 being visible. On the flow medium side, the steam generator tubes 12 thus disposed side by side are preceded upstream of their inlet 13 to the heating gas duct 6 by a common inlet header 14 and followed downstream of their outlet 16 from the heating gas duct 6 by a common outlet header 18. The steam generator tubes 12 comprise a plurality of riser tube sections 20 through which flow medium W flows in the upward direction and downcomer tube sections 22 through which it flows in the downward direction, these being interconnected by crossflow sections 24 through which the flow medium W flows horizontally.

The continuous steam generator 1 is designed for particularly high operating reliability and consistent suppression of significant temperature differences (also termed temperature unbalance) at the outlet 16 between adjacent steam generator tubes 12 even when the steam generator is fed with comparatively high mass flow densities. For this purpose the continuous evaporator heating surface 8 comprises, in its downstream region viewed from the flow medium side, a heating surface segment 26 connected countercurrently to the heating gas direction x. A number of riser tube sections 20 and downcomer tube sections 22 interconnected by crossflow sections 24 additionally form a further heating surface segment 28 connected cocurrently with the heating gas direction x upstream of the heating surface element 26. This configuration means that the positioning of the outlet 16 is selectable in the heating gas direction x. This positioning can be selected for the continuous steam generator i in such a way that the pressure-dependent saturated steam temperature of the flow medium W arising in the continuous evaporator heating surface 8 during operation deviates by less than a specified maximum deviation of approximately 50° C. from the heating gas temperature obtaining at the position or at the height of the outlet 16 of the heating surface segment 26 during operation. As the temperature of the flow medium W at the outlet 16 must always be at least equal to the saturated steam temperature, but on the other hand may be higher than the heating gas temperature obtaining at this point, the possible temperature differences between differentially heated tubes can be limited to the specified maximum deviation of approximately 50° C. without additional countermeasures.

The heating surface segment 28 disposed well upstream in the heating gas duct 6 in the heating gas direction x is therefore followed on the heating gas and flow medium side by the heating surface segment 26 likewise formed from a number of riser tube sections 20 and downcomer tube sections 22 interconnected by crossflow sections 24 and through which the flow medium flows countercurrently to the heating gas direction x.

An arrangement of tube sections though which flow medium flows in the downward direction, like the downcomer tube sections 22 inside the heating gas duct 6, is basically only possible if the stability of the flow within the steam generator tubes 12 is ensured by suitable measures. Heating of tube sections through which flow medium flows in the downward direction tends to result in the formation of steam bubbles in the flow medium W which, if they rise against the flow direction of the flow medium W because of their low specific gravity, may adversely affect flow stability and therefore the operational reliability of the continuous steam generator 1. On the other hand, a configuration of the steam generator tubes 12 whereby only the tube sections through which flow medium flows in the upward direction, i.e. the risers 20, are heated, involves high construction costs.

A particularly simple and therefore also robust type of construction of the continuous steam generator 1 can be achieved by making the continuous evaporator heating surface 8 particularly simple in respect of collecting and distributing the flow medium W and eliminating additional components such as collecting tubes. Instead of this, the steam generator tubes 12 incorporate a plurality of alternating riser 20 and downcomer tube sections 22 connected in series on the flow medium side which are mounted inside the heating gas duct 6, i.e. subjected to heating by the heating gas.

The inlet 13 is disposed at the gas-side inlet of the continuous evaporator heating surface 8, i.e. in the heating gas duct 6 well upstream in the heating gas direction x. By disposing the inlet 13 in the area of the heating gas duct 6 in which the heating gas has the highest temperature, very rapid heating and therefore evaporation of the flow medium W in the steam generator tubes 12 is achieved. As the flow rate of the water-steam mixture, the mass flow rate being equal, is higher the greater the steam portion and therefore the specific volume of the mixture, with this arrangement of the inlet header 14 the flow medium W attains a high flow rate comparatively quickly.

This is particularly favorable in order to ensure the stability of the flow taking place in the steam generator tubes 12. An important factor severely detrimental to flow stability is the occurrence of steam bubbles in the steam generator tubes 12. Because of their low specific weight, gas bubbles forming may rise upward in the steam generator tubes 12, thereby moving against the flow direction in the downcomer tube section 22. As a movement of this kind would seriously impair flow stability, the rising of steam bubbles produced in the steam generator tubes 12 must be consistently prevented. An important criterion for flow stability is the flow rate of the flow medium W. If, in the first tube section through which the flow medium flows in the downward direction, i.e. in the first downcomer 22, it already has a value at least as high as the rate required for entrainment of the steam bubbles, said bubbles will be entrained with the flow and any rising movement contrary to the flow direction will be reliably eliminated. The positioning of the inlet 13 at the heating-gas-side inlet and the resultant high flow rate of the flow medium W even in the first downcomer tube section 22 ensures the desired entrainment effect on the steam bubbles forming, while at the same time minimizing construction costs.

The invention claimed is:

1. A continuous steam generator, comprising:

a heating gas duct through which heating gas flows in an approximately horizontal direction;

a continuous evaporator heating surface disposed in the heating gas duct and comprising a number of parallel-connected steam generator tubes that provide a flow path for a flow medium;

a first heating surface segment incorporated with the continuous evaporator heating surface and through which the flow medium can flow countercurrently to the heating gas duct; and a second heating surface segment arranged upstream of the first heating surface segment in the heating gas duct;

wherein a flow medium side inlet of the continuous evaporator heating surface is disposed close to a heating gas side inlet of the continuous evaporator heating surface, and wherein the flow medium side inlet of the continuous evaporator heating surface comprises a riser tube section.

2. The continuous steam generator according to claim 1, wherein a number of steam generator tubes incorporate a plurality of alternating riser and downcomer tube sections connected in series.

3. The continuous steam generator according to claim 1, wherein the second heating surface segment is connected countercurrently to the heating gas direction.

4. The continuous steam generator according to claim 1, wherein the second heating surface segment is connected cocurrently with the heating gas direction.

5. The continuous steam generator according to claim 1, wherein a gas turbine is connected upstream on the heating gas side.

6. A method for operating a continuous steam generator, comprising:

providing a heating gas duct through which heating gas flows in an approximately horizontal direction and which has a continuous evaporator heating surface comprising a number of parallel-connected steam generator tubes which provide a flow path for a flow medium; and educting the flow medium from the continuous evaporator heating surface;

wherein, at or immediately after the inlet to the steam generator tubes, the flow medium is subjected to strong heating such that it exhibits, in a first downcomer tube section of the relevant steam generator tube, a flow rate of more than a predefined minimum rate.

7. The method according to claim 6, wherein the flow medium upstream of its outlet from the continuous evaporator heating surface is supplied countercurrently to the heating gas.

8. The method according to claim 6, wherein the flow rate required for entraining steam bubbles produced in the respective first downcomer tube section is predefined as the minimum rate.

9. The method according to claim 6, wherein downstream of its inlet to the continuous evaporator heating surface the flow medium is supplied countercurrently to the heating gas.

10. The method according to claim 6, wherein, downstream of its inlet to the continuous evaporator heating surface the flow medium is fed cocurrently with the heating gas.

* * * * *